United States Patent [19]

Miani

[11] 4,259,048

[45] Mar. 31, 1981

[54] EXTRUSION HEAD FOR PRODUCING SYNTHETIC AND THE LIKE TEXTILE YARNS

[76] Inventor: Mario Miani, Via Enrico Fermi, 9, RHO (Province of Milano), Italy

[21] Appl. No.: 40,813

[22] Filed: May 21, 1979

[30] Foreign Application Priority Data

May 24, 1978 [IT] Italy ..... 23761 A/78

[51] Int. Cl.[3] ..... B29C 25/00

[52] U.S. Cl. ..... 425/72 S; 264/176 F; 264/237; 425/464

[58] Field of Search ..... 425/72 S, 464; 264/176 F, 237

[56] References Cited

U.S. PATENT DOCUMENTS

| | | | |
|---|---|---|---|
| 2,923,970 | 2/1960 | Genovese | 264/176 F |
| 3,006,027 | 10/1961 | Hildebrandt et al. | 264/196 |
| 3,135,811 | 6/1964 | Barnett et al. | 425/72 S |
| 3,695,858 | 10/1972 | Russell | 264/176 F |
| 3,959,057 | 5/1976 | Smith | 425/72 S |
| 3,969,462 | 7/1976 | Stofan | 264/237 |
| 4,038,357 | 7/1977 | Boyes et al. | 264/176 F |
| 4,124,666 | 11/1978 | Wilhelm et al. | 264/176 F |

FOREIGN PATENT DOCUMENTS

| | | | |
|---|---|---|---|
| 38-7511 | 5/1963 | Japan | 264/176 F |
| 46-34926 | 10/1971 | Japan | 425/72 S |
| 47-21251 | 6/1972 | Japan | 264/237 |
| 53-9293 | 4/1978 | Japan | 264/237 |

*Primary Examiner*—Jay H. Woo

*Attorney, Agent, or Firm*—Guido Modiano; Albert Josif

[57] ABSTRACT

An extrusion head for producing synthetic and the like textile yarns comprises a channel for feeding the plastics material stock to be extruded, which channel opens into an extrusion chamber having an annular shaped die provided thereon with a plurality of calibrated holes evenly distributed with respect to the feeding channel, so that the distance of each hole from the feeding channel and the extrusion conditions are the same.

3 Claims, 2 Drawing Figures

EXTRUSION HEAD FOR PRODUCING SYNTHETIC AND THE LIKE TEXTILE YARNS

BACKGROUND OF THE INVENTION

This invention relates to an extrusion head for producing synthetic and the like textile yarns.

Currently known are apparata for spinning conventional polypropylene fibers, of either circular or non-circular cross-section, which can produce directly from the granule a polypropylene staple which is crimped and cut and has good technical properties.

Such apparata include in general an extrusion head, internally whereto one or more feeding chambers are arranged which are provided with dies having calibrated holes distributed across them.

Said currently known dies have a substantially rectangular configuration, thereby serious problems are encountered in obtaining a uniform distribution of the plastics material stock, which is introduced at a central position, all over the die surface.

The difficulty of providing an even distribution of the plastics material across the die surfaces leads to several shortcomings, the first of which results from a degree of uneveness in the quality of the extruded material, which is in the form of a yarn and is then subjected to further processing steps, not discussed herein because beyond the scope of this invention.

Several techniques have been utilized thus far in an attempt to achieve a more even distribution of the plastics across the dies during the feeding process, but these have failed to solve the problem in any radical manner, thereby rectangular shape dies unavoidably develop preferential areas for the passage of the plastics, thus resulting in the production of uneven yarns.

Another problem presented by rectangular shaped dies is that the blowers which direct air at a preset temperature onto the yarns as these emerge from the extruder are of complex construction, since they are required to impinge in a substantially even manner on the group of yarns emerging from the extruder.

SUMMARY OF THE INVENTION

This invention sets out to eliminate the draw-backs experienced heretofore, by providing an extrusion head that is structured such as to afford a complete and even distribution of the plastics material stock to be extruded across the extrusion die.

Within the above general aim, it is further possible to arrange that the extrusion head of the present invention, additionally to having a simplified structure, also affords improved quality and higher output rate capabilities.

It is further possible to arrange that the extrusion head of the present invention, while being extremely simple in construction, further results in constructional simplifications of the cooling air blowers for the extruded plastics.

It is, moreover, possible to arrange for the extrusion head according to the present invention to be easily manufactured from elements and materials which are commonly available on the market, thus being quite competitive even from a merely economical standpoint.

According to one aspect of the present invention, there is provided an extrusion head for producing synthetic and the like textile yarns comprising a channel for feeding the plastics material stock to be extruded, said channel opening into an extrusion chamber having a die provided with a plurality of calibrated holes, characterized in that said die has an annular configuration and said holes are evenly distributed thereon with respect to said feeding channel.

BRIEF DESCRIPTION OF THE DRAWING

Further features and advantages will be more clearly apparent from a detailed description of a preferred but not limitative embodiment of an extrusion head for producing synthetic textile yarns according to this invention, illustrated by way of example only in the accompanying drawing, where.

DESCRIPTION OF A PREFERRED EMBODIMENT

Figure 1:
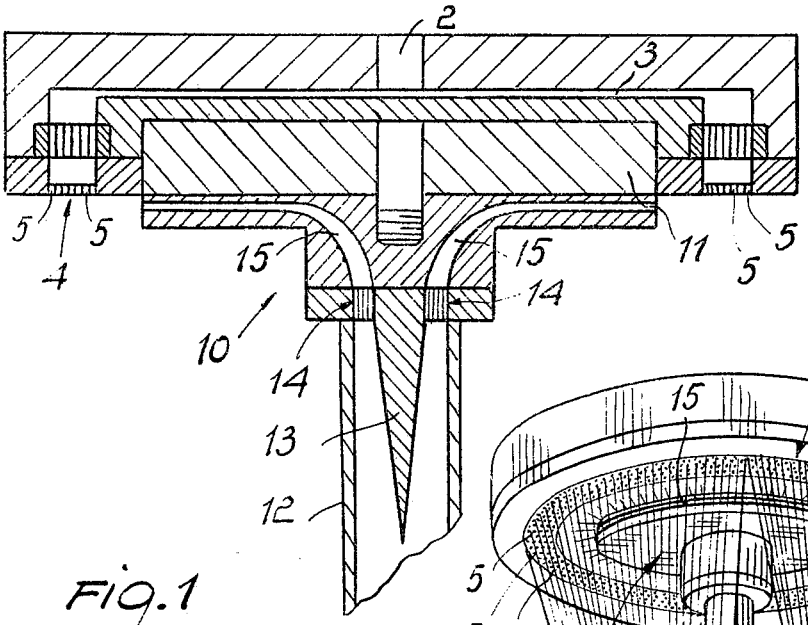
FIG. 1 is a detail cross-sectional view of the extrusion head.

With reference to the drawing figures, the extrusion head of this invention, which is generally indicated at 1, comprises a feeding channel 2 opening into an extrusion chamber 3 of substantially cylindrical shape.

Said extrusion chamber 3 includes, on the opposite side thereof to said feeding channel 2, a die 4 having an annular configuration and being provided with a plurality of calibrated holes 5, the size whereof will be directly related to the denier of the yarn to be produced.

By providing a die 4 of annular shape, and evenly or uniformly arranged around the feeding channel 2, affords in the first place the all important advantage of producing a uniform or even distribution of the plastics material stock during the process of extruding it, because no preferential passage channels are allowed to form. Indeed, it is the very equidistance of each point of the die from the feeding channel 2 that results in the resistances met by the plastics to be extruded in its path being the same at any points of the extruder, thus ensuring a uniformly carried out extrusion process.

The cited extrusion head 1 is also equipped with a blower, generally indicated at 10, which is arranged, with the interposition of an asbesto layer 11, for direct connection to the head 1, in the enclosed portion of the die 4; thereby, it only requires a very simple technique to provide a uniform distribution also for the air which impinges upon the extruded yarns from the blower.

The blower 10 includes a feeding or suction duct 12 which extends from the bottom upwards, towards the extrusion head 1, and has a flow divider 13 effective to promote the partition of the air flow supplied through the duct 12 to multiple radial channels 14 of discoidal nozzle. The channels 14 are evenly distributed circumferentially and open into an annular slit 15 through which the air is ejected at the die 4 in the form of a laminar discoidal centrifuge jet.

Figure 2:
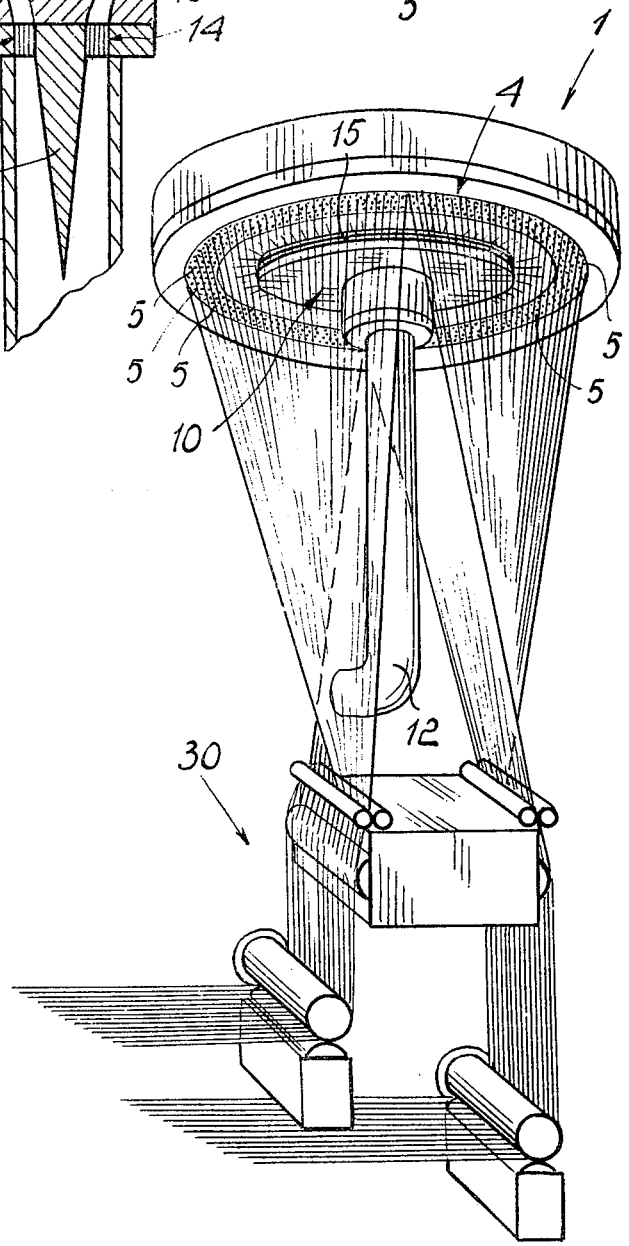
FIG. 2 shows, schematically and in perspective, the extrusion head.

As shown in FIG. 2, the threads emerging from the die 4 are in general separated into two groups comprising each one half of the yarns or filaments egressing from the die 4 and coveyed onto diverting rollers 30, not discussed in detail herein because known per se; by dividing the yarns in two groups, it becomes possible to leave between them a free area for the passage of the feeding duct 12 of the blower therethrough, without in any way interfering with the filaments themselves.

The operation of the extrusion head according to the invention is extremely simple, and fairly obvious from the foregoing description. In fact, the plastics material stock from the feeding channel 2 is admitted to the extrusion chamber 3 where it can distribute itself uniformly, by virtue of the circular geometry, and from which it is then transferred to the die 4 of annular shape. Through the calibrated holes 5 of the die 4, the various emerging filaments have already achieved their desired size, are separated in two halves each involving in practice a half circumference of the die 4, and are passed to diverting rollers 30 whence they will undergo various processing steps through the plant, no further described herein.

It will be appreciated from the above description that the invention achieves its objects, and in particular the fact is pointed out that the provision for a die of circular shape ensures both a uniform distribution and increased hourly output of the apparatus.

It should be added to the foregoing that the die and the slit are coaxial to each other with any lay of their axis, i.e. vertical, horizontal and arbitrarily inclined.

The invention as described is susceptible to several modifications and variations, all of which are intended to fall within the scope of the instant inventive concept.

Furthermore, all of the details may be replaced by other technically equivalent elements.

In practicing the invention, the materials employed, as well as the dimensions, may be any ones to suit individual applicational requirements.

I claim:

1. An extrusion head for producing synthetic and the like textile yarns, comprising a channel for feeding the plastics material stock to be extruded, said channel opening into an extrusion chamber of substantially cylindrical shape having a die of annular configuration located at the peripheral edge of said extrusion chamber and provided with a plurality of calibrated holes evenly distributed thereon with respect to said feeding channel and defining an extrusion direction, a blower positioned inside the area confined by said annular shaped die, wherein according to the improvement said blower has a feeding duct extending parallel to said extrusion direction beneath said extrusion head and a discoidal nozzle on said duct defining at its periphery a single annular slit opening at the inside edge of said annular die and directed perpendicular to said extrusion direction thereby to form in operation a single laminar centrifugal discoidal jet of cooling air impinging perpendicularly against the just extruded yarns close to said die holes.

2. An extrusion head according to claim 1, further comprises a divider member between said feeding duct and said discoidal nozzle.

3. An extrusion head according to claim 1, wherein said die and said annular slit are coaxial to each other.

* * * * *